United States Patent [19]

Rosen

[11] Patent Number: 4,458,834

[45] Date of Patent: Jul. 10, 1984

[54] INFANT CARRIER

[76] Inventor: Joyce B. Rosen, 915 E. 27 St., Brooklyn, N.Y. 11210

[21] Appl. No.: 424,077

[22] Filed: Sep. 27, 1982

[51] Int. Cl.[3] ..... A47D 13/02

[52] U.S. Cl. ..... 224/160; 224/159

[58] Field of Search ..... 224/159, 160, 161, 155

[56] References Cited

U.S. PATENT DOCUMENTS

| | | | |
|---|---|---|---|
| 2,468,588 | 4/1949 | Clemens, Jr. | 224/159 |
| 3,780,919 | 12/1973 | Hansson | 224/160 |
| 4,271,998 | 6/1981 | Ruggiano | 224/160 |

FOREIGN PATENT DOCUMENTS

| | | | |
|---|---|---|---|
| 123094 | 12/1946 | Australia | 224/161 |
| 2028633 | 3/1980 | United Kingdom | 224/160 |

*Primary Examiner*—Steven M. Pollard

*Attorney, Agent, or Firm*—Raymond Underwood; Terence P. Strobaugh

[57] ABSTRACT

A carrier for suspending an infant from a person's shoulders has a seat and a partial back support, a separate back which is removably attached to said partial back support so it can be adjusted and shoulder bands attached to the front and rear of the seat; the front attachment being separable from the seat. A rain-sun hood is removably attached to the back as an option. The back is stiffened with plastic so that its curvature around the back makes it stiffer.

7 Claims, 6 Drawing Figures

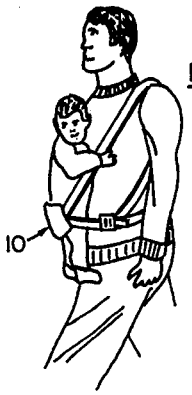
FIG. 1
FIG. 3
FIG. 4
FIG. 2
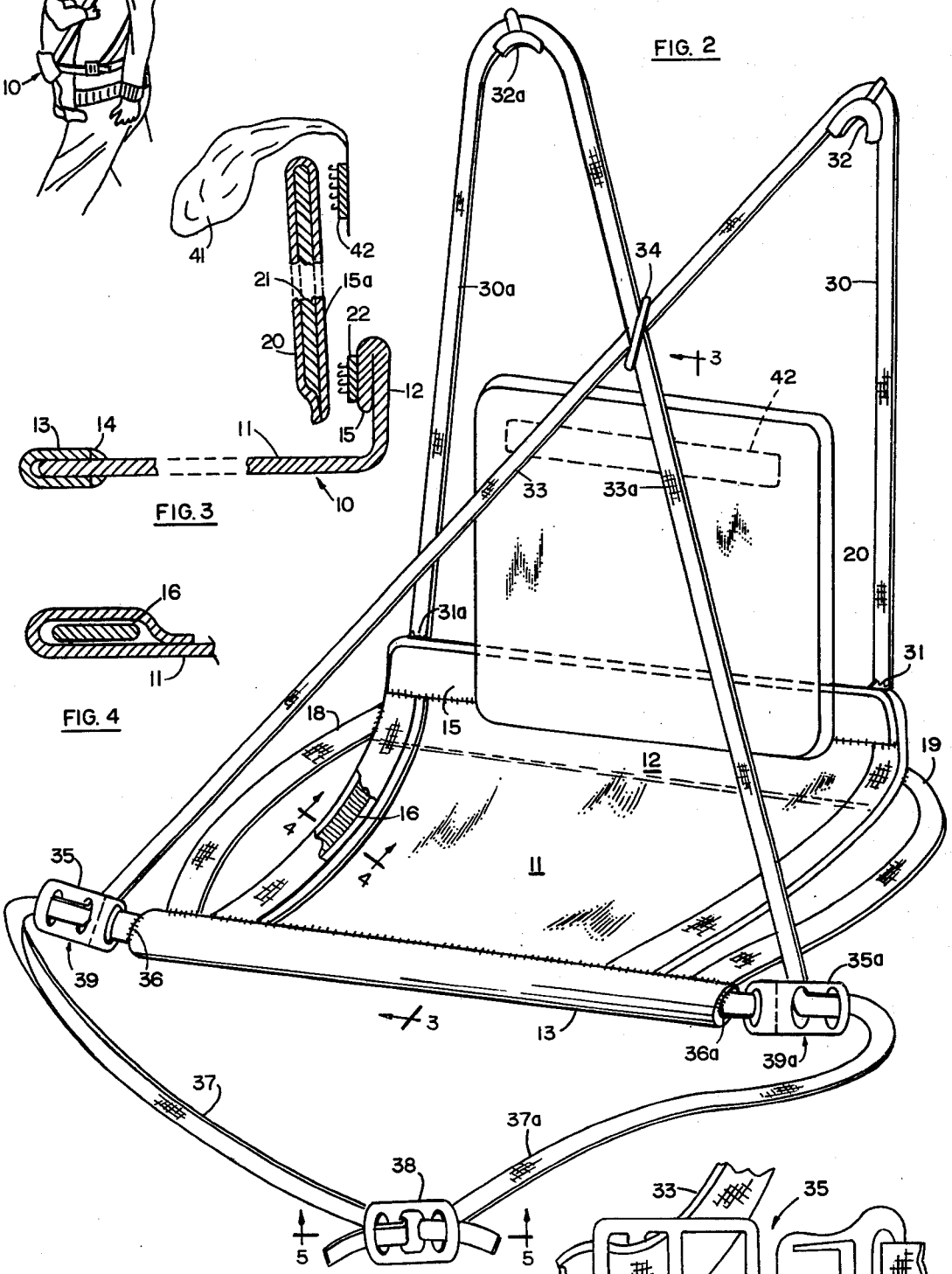
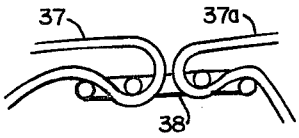
FIG. 5
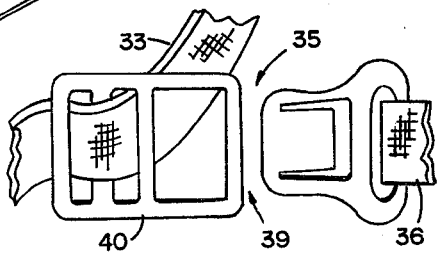
FIG. 6

INFANT CARRIER

This invention relates to infant carriers and particularly to an article of the sling type which supports an infant on a person's chest; the carrier being suspended by shoulder straps.

Carriers of this general type make it more comfortable to carry an infant as it eliminates the need to hold the infant in the person's arms. As the weight of the infant is borne by the shoulders instead of the arms and hands, the hands are free to perform other activities. It is much less tiring to move about or even sit still with the infant suspended from the shoulder in such a sling carrier, than to have to carry the infant's weight entirely in the arms and hands.

An advantage of this type of infant carrier is that the infant faces the person's face and the feeling of mutual security is established. The person can talk directly to the infant to establish a close relationship and the person can observe the infant and determine its needs; this is not possible if the infant is carried on the person's back.

Carriers of this general type are known but they are not entirely satisfactory because they are hard for a person to put on and to place the infant in position. The conventional front carrier is not adjustable so as to adapt them to the growing size of the child. Many of the known carriers are bulky and require considerable material and this makes them expensive.

The present invention makes it possible to quickly apply the carrier to the person and to place the infant in position. It includes a novel adjustable feature to fit the size of the infant and growing child. Its structure is relatively simple and this makes it possible to easily and cheaply construct it at a low cost so that it is an inexpensive article. An optional feature of the invention is the provision of an attachable-detachable hood or cap to protect the infant's head against rain and sunlight. Other advantages will appear from the following description.

In this description, the word infant is used in a generic sense to include babies and small children who are to be carried about. Because of the adjustable feature the one size of carrier will fit a growing infant but of course, the carrier can be made in a variety of sizes and relative proportions.

A preferred embodiment of the invention is shown in the drawings, in which:

FIG. 1 shows the use of the article,

FIG. 2 is a perspective view of the carrier,

FIG. 3 is a vertical section on the line 3—3 of FIG. 2 with the parts detachable and with parts broken away, some of the elements being exaggerated in relative size to better show the details, FIG. 4 is a section on the line 4—4 of FIG. 2, FIG. 5 is a section on the line 5—5 of FIG. 2 and FIG. 6 shows the buckle detached.

The seat 10 is made up of a central portion 11 on which the infant is seated, a rear upstanding portion 12 which comes up behind the infant and a front portion 13 which in use is upstanding and comes against the wearers chest. As here shown, the front portion 13 is a separate band which is wider than the central portion and which is stitched at 14 to the central portion but if desired the portions 11, 12, 13 can all be one piece.

The seat is made of velour like material as the outer surface presents a pile appearance and the inner surface, on which the infant sits is of a knitted consistency. This is preferred but the invention can be practiced with other cloth materials. The top edge of the rear upstanding portion 12 can be turned and folded on itself as shown at 15 for strengthening purposes.

The front portion 13 which can be upturned is folded on itself as shown in FIG. 3 and if desired for strengthening purposes a strip of cardboard like material can be inserted in this tubular portion. The side edges of the seat can be folded over as shown in FIG. 4 to enclose an elastic strip of the usual kind as indicated at 16. This elastic 16 is fastened at its ends and its tendency to contract the edges serves to shape the central portion 11 into a depressed seat to better hold the infant.

Leg bands 18 and 19 are provided to form openings between them and the seat for the infant's legs to extend through. These leg bands are made out of the same velour like material which is folded on itself and stitched to form a tube. Within it is an elastic band or strip, similar to 16 to tend to contract these leg bands 18 and 19. These bands are attached, with the elastic ends, to the rear portion 12 and the front portion 13 as appears in FIG. 2.

This seat is fully safe for the infant to sit on as the bands 18 and 19 tend to hold the child's legs in place. Also, the elastic strips 16 tend to contract the seat up and around the infant and form the seat in a shallow pocket or depression. For added safety a back may be provided.

The back 20 is preferably made of the same velour like cloth material which is folded on itself and stitched to form a closed container. Inside of the back 20 is preferably a flexible stiffening sheet such as of rigid PVC or a relatively stiff sheet 21. When the child rests against it it is formed into a slightly cylindrical shape which stiffens it against bending.

To permit the adjustable location and as a feature of this invention, the back 20 is removably attached to the upright portion 12 of the seat by a Velcro band 22. This has the well known minute plastic hooks which hook into the loops of another material which is brought against it. The pile formation of the velour like material a 15*a* is such a surface and this holds the back 20 against displacement. The back can be removed and readily be placed in another position.

The seat 10 and the back 20 are suspended from the wearer's shoulders by the two bands or belts 30 and 30*a* which are the same but are oppositely located. For this reason a description of the band 30 will suffice for a description of the other band 30*a* at the parts thereof having the subscript "a". The band 30 is attached to the top end edge of the upstanding portion 12 at 31.

From this attachment at 31 the band 30 is intended to lead up the front of the wearer and go over the shoulder and descend down and across the back. To ease the pressure on the shoulder the slip pads 32 of conventional construction may be provided. As is shown in FIG. 2 the back portion 33 of the band descends diagonally across the wearer's back and where it crosses the band portion 33*a*, there may be a slip ring 34 to partially tie them together.

The lower portion of 33 is to be brought around to the front of the wearer at the waist and it is to be connected to the slip buckle 35 which itself is attached to the front far corner of the seat at 36. As is here shown this attachment is at the end of the front band 13 which is to be turned upright. It is to be noted that the attachment at 36 is diagonally opposite from the attachment of the same band at 31 and this forms a very stable suspension.

The band portion 33 can slip in the buckle 35 to fit the size of the wearer and the manner in which the band is looped through the buckle tends to prevent slippage when the carrier is being worn. From the slip buckle 35 the band portion 37 leads to the tie buckle 38 which serves as a tie for the other band portion 37*a*. This tie buckle 38 is at the back of the person at the waist area. The terminal portions at the buckle 38 could of course be hand tied together but the buckle serves as well and is more convenient.

It is preferred, but not necessary, that the slip buckles 35 and 35*a* be separable along the area 39 and 39*a* respectively. As is shown in FIG. 6 this means that one part is permanently attached at 36 and 36*a* to the seat and the other part 40 has only the looped band threaded through it. With such a separable buckle the entire carrier can most easily be put on a person and be adjusted as to size the first time, after which it can be easily removed by separating the the buckles 35, 35*a*. The next time it is worn no adjustment is necessary as the buckles 35, 35*a* merely need to be reconnected.

Some persons will find it easiest to wear and place the infant in the carrier when the person is sitting down. The infant can be placed on the seat before the buckles 35, 35*a* are connected (if they are separable) as this makes it easy to put the infant's legs under the leg bands 18, 19. When the baby is comfortably seated the buckles 35,35*a* can be reconnected.

As an optional feature of the invention, a rain or sun hood 41 may be provided and it should be shaped like the ordinary raincoat hood to somewhat fit the head. It should have attached to it a Velcro strip 42 which will attach itself to the rear side of the back 20. It can altogether be removed if desired or it can merely be left hanging off of the infant's head.

The carrier is extremely comfortable to wear and one reason for this is that the child is not forcibly pulled against the person's chest as some carriers do. The infant is comfortable as it is not squezzed. The back 20 is securely attached to hold the infant upright and an important feature is the inside stiffening 21 which curves around the infant's back and is thereby made more firm. The adjustable feature of the back 20 has another advantage as it can be placed to give the mother added privacy if she is nursing the infant.

A suitable material for the cloth parts is obtainable from the Daizans Co. of New York City under the fabric name Tempo and equivalent material may be used.

The separable buckle 35 obtainable from the American Cord and Webbing Co. in New York City as Model 910.

A suitable band or tape material for the bands 30 is Nylon webbing sold by the American Cord and Webbing Co. in New York City and other suitable bands may be used.

I claim:

1. A carrier for holding an infant on a person's chest in suspended position comprising a seat portion, said seat portion having an upturned rear edge portion forming a partial back support for the infant and a front edge portion to bear against the person's chest; leg bands at both sides of the seat portion to from openings for receiving the infant's legs; a yieldably firm back removably attached to said upturned rear portion by a strip of minute hooks; first and second bands attached to opposite side edges of said upturned rear edge portion and adapted pass up and over opposite shoulders of the person and downwardly crosswise across the person's back to a slipping attachment at opposite sides of said front edge portion and around behind the person, means for attaching, said first and second bands together behind the person.

2. The carrier of claim 1 in which elastic bands are in the side edges of said seat portion to draw on the sides and form the seat into a recessed formation.

3. The carrier of claim 1 in which said front edge is upturned to bear against the person.

4. The carrier of claim 1 in which said back encloses a stiffening element which is increasingly rigid when curved by pressure of the infant's back into a curved shape.

5. The carrier of claim 1 which also includes a rain hood which is removably attached to the back by a strip of minute hooks.

6. The carrier of claim 1 in which said slipping attachment to said front edge portion is by means of a buckle which is attached to said front edge.

7. The carrier of claim 6 in which said buckle is separable so that the band is separable from the seat.

* * * * *